US006340422B1

(12) United States Patent
Vries et al.

(10) Patent No.: US 6,340,422 B1
(45) Date of Patent: Jan. 22, 2002

(54) METHOD FOR ELECTROPLATING METALLIC AND NON-METALLIC ENDLESS PRODUCTS AND DEVICE FOR CARRYING OUT SAID METHOD

(75) Inventors: Hans de Vries, Heerde (NL); Jörg Heller, Engelskirchen (DE)

(73) Assignee: Aluminal Oberflachentechnik GmbH (DE)

( * ) Notice: Subject to any disclaimer, the term of this patent is extended or adjusted under 35 U.S.C. 154(b) by 0 days.

(21) Appl. No.: 09/403,430

(22) PCT Filed: Apr. 15, 1998

(86) PCT No.: PCT/EP98/02196

§ 371 Date: Nov. 1, 1999

§ 102(e) Date: Nov. 1, 1999

(87) PCT Pub. No.: WO98/48081

PCT Pub. Date: Oct. 29, 1998

(30) Foreign Application Priority Data

Apr. 19, 1997 (DE) ..... 197 16 493

(51) Int. Cl.[7] ..... C25D 5/00; C25D 5/54; C25D 7/06; C25D 5/34; C25D 5/48

(52) U.S. Cl. ..... 205/137; 205/159; 205/138; 205/210; 205/220

(58) Field of Search ..... 205/138, 151, 205/159, 210, 220, 238, 261; 204/198, 269, 237, 203

(56) References Cited

U.S. PATENT DOCUMENTS 4,401,522 A * 8/1983 Buschow et al. ..... 204/15
4,419,204 A * 12/1983 Birkle et al. ..... 204/206
4,444,636 A * 4/1984 Doerzer et al. ..... 204/206
5,779,961 A * 7/1998 Teutsch ..... 264/176.1
6,036,824 A * 3/2000 Hedgcoth ..... 204/192.16

FOREIGN PATENT DOCUMENTS

JP 63-227797 * 9/1998

* cited by examiner

*Primary Examiner*—Edna Wong
(74) *Attorney, Agent, or Firm*—Kilpatrick Stockton, LLP

(57) ABSTRACT

The present invention is directed to processes and devices for performing the processes comprising electroplating one or more metallic or non-metallic continuous products with metals or metal alloys in a continuous process from aprotic electrolytes free of water and oxygen, wherein the continuous product is passed through a lock system (1) into an encapsulated coating plant under inert gas atmosphere, and the following steps are performed at temperatures ≦120° C.:

activating the continuous product to be coated;

rinsing the continuous product to be coated;

contacting the continuous product to be coated;

electroplating the continuous product to be coated using a metal or metal alloy;

drying the coated continuous product;

discharge of the coated continuous product from the plant through a lock system.

16 Claims, 4 Drawing Sheets

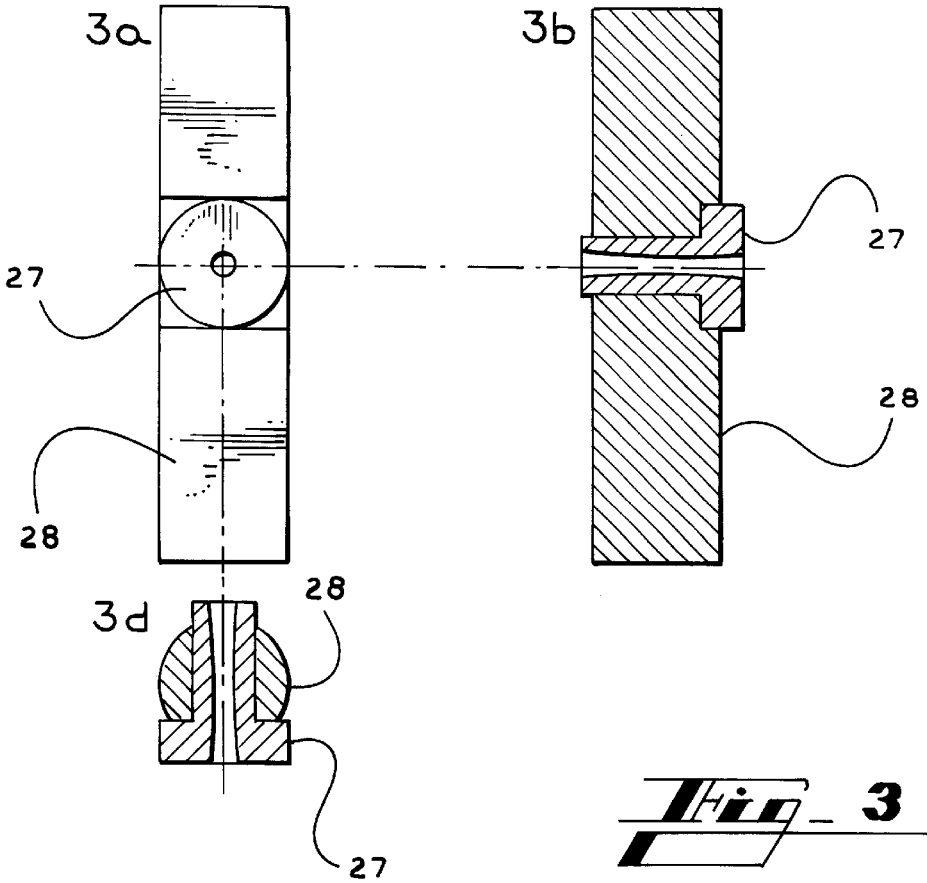
Fig. 3
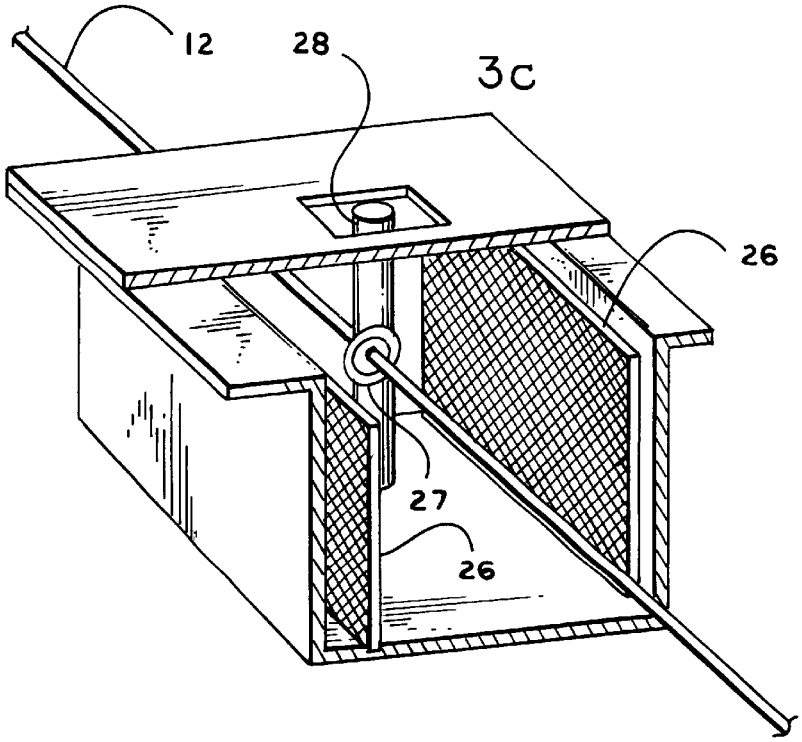

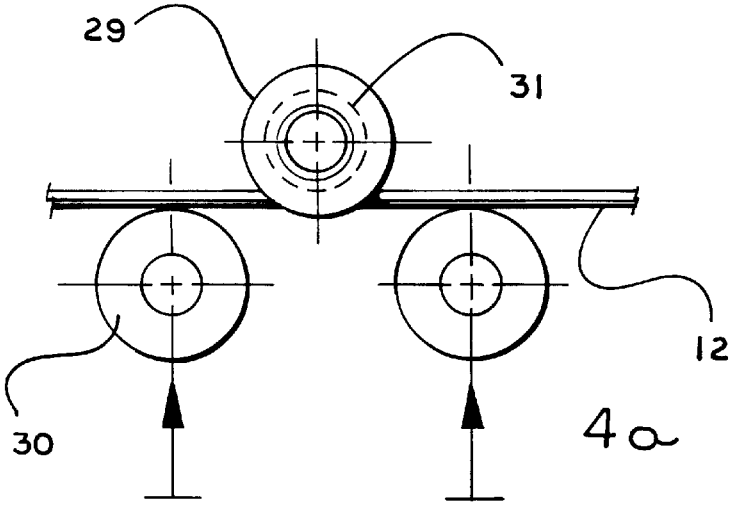
Fig. 4
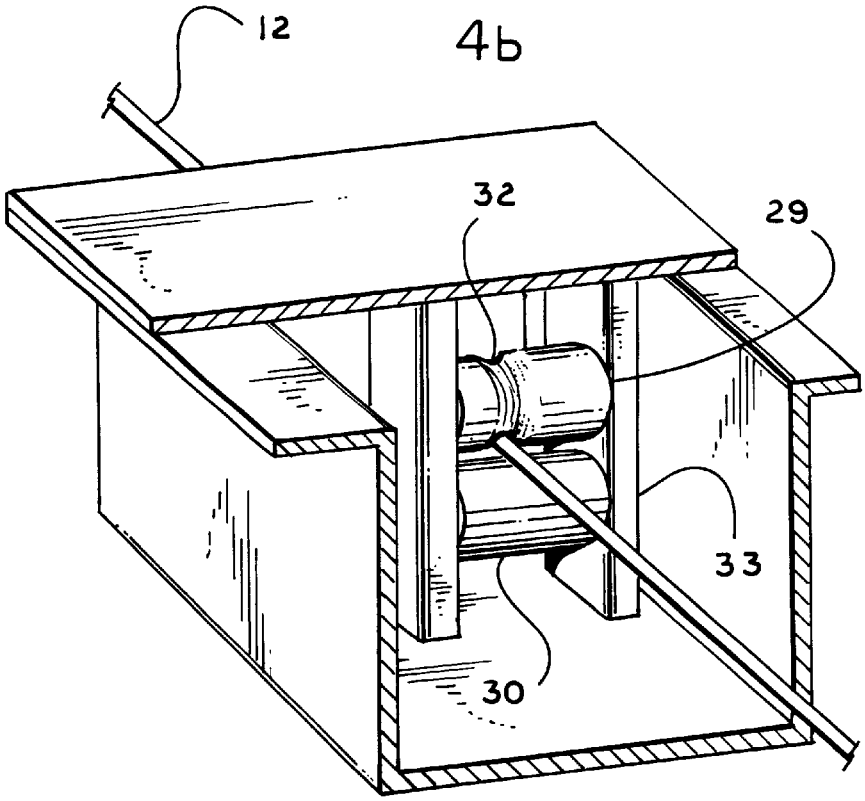

METHOD FOR ELECTROPLATING METALLIC AND NON-METALLIC ENDLESS PRODUCTS AND DEVICE FOR CARRYING OUT SAID METHOD

This is a national stage application of PCT/EP98/02196 filed Apr. 15, 1998.

The invention is directed to a process for electroplating metallic or non-metallic continuous products with metals or alloys in a continuous process from aprotic electrolytes free of water and oxygen. The invention is also directed to a device for performing said process.

According to the state of the art, continuous products such as wire, tapes, long-profiles, or pipes have been produced using aqueous electrolytic methods or by means of molten bath coating in a continuous process.

In a well-known electroplating process, for example, a wire is coated with various coatings, such as zinc, nickel or other metals where the wire is passed through open cleaning and electroplating baths containing aqueous solutions. In these baths, the respective metal is deposited on the wire, and the thickness of the coating layer depends on the passage rate and the electric field strength. In this process, however, the deposition rate as a function of time is rather low, and the deposited coating frequently is highly porous and rigid, giving rise to inferior corrosion resistance, particularly in thin coatings. As a result of lacking ductility, the subsequent forming procedures may give rise to cracks in the deposited layer or even flaking of the coating. Such a coating completely loses its corrosion-protective character and also, the surface is no longer decorative.

Furthermore, in the electrolytic deposition of a coating metal from an aqueous solution, the full-scale cathode or anode efficiency has never been reached. In general, side reactions occur at high current densities required for continuous coating, giving rise to decomposition products in the electrolyte and evolution of gas. Here, in particular, evolution of hydrogen takes place on the product, which may result in embrittlement of the basic material.

Another drawback is that the aqueous electroplating processes and hot-dip processes produce large amounts of toxic exhaust air and waste waters which must be purified by correspondingly expensive procedures where in any case, toxic special waste remains. For example, due to fat residues on the metals to be coated, which are present prior to alkaline cleaning in the appropriate solutions, residues of organic compounds are formed which, as a result of the high temperatures in the zinc tank, being around 450° C., may react to give extremely toxic organic compounds such as dioxins and furans. Furthermore, metal sludges, used acids and exhausted alkaline cleaners are produced. In addition to the aforementioned waste gases, acid vapors and alkaline vapors are also produced.

Other processes for coating continuous products are known, which are based on the deposition of decorative and corrosion-reducing coatings in a molten state. In this context, the so-called zinc dipping (hot-dip galvanizing) and hot-dip aluminizing are known. In hot-dip galvanizing, a previously cleaned and activated continuous product, e.g., a thin wire is passed through high-purity molten zinc in a continuous process. This process takes place at temperatures above 440° C., so that in any event, there is also a mechanical impact on the material to be coated. Due to the high temperatures, certain other basic materials desired to be coated cannot be coated at all. Another drawback is the relative non-uniformity of the deposited coating and the highly layer-dependent corrosion resistance. As a result of the stripping process, the surface may be void of any decorative character. A colored design of the surface is not possible.

In all the coating processes associated with zinc, there is blooming on the surface as a result of the formation of zinc oxides and zinc carbonates after a short period of corrosion and thus, a negative change of the surface with respect to the optical impression. Therefore, uniformity of the coating in these thermal processes is not ensured.

Another familiar process is the so-called high-temperature hot-dip aluminizing. In this process, a wire is drawn through a molten aluminum bath in the same way as in zinc coating and subsequently subjected to a stripping process. In this way, however, coatings are obtained exhibiting similar drawbacks as in hot-dip galvanizing described above. Layers coated by means of hot-dip aluminizing have not proven successful due to their insufficient purity, high porosity and inevitable oxidic inclusions and thus, inferior corrosion resistance. Other drawbacks can be seen in that the coating does not look decorative and in some cases, at the temperatures required for hot-dip aluminizing, there is a massive mechanical impact on the material to be coated.

In accordance with the state of the art, galvanizing may also be combined with hot-dip aluminizing, which results in a somewhat improved corrosion layer due to the active cathodic protective effect of the aluminum. However, the lacking decorative character is disadvantageous. In addition, there are other drawbacks for merely that reason that coating is effected at high temperatures.

The state of the art also includes aluminum electrodeposition processes performed in aprotic electrolytes free of water and oxygen wherein deposition of the aluminum is effected from baths containing alkyl aluminum complexes of alkali metal halides and aluminum alkyls. In general, aromatic or aliphatic hydrocarbons are used as solvents. Such electrolyte solutions are described in EP 0,402,761 A and EP 0,084,816 A, for example.

However, such electrolyte solutions have solely been used in the coating of rack products where the individual parts are arranged in appropriate racks to be immersed into the respective electrolyte baths. To date, aluminizing of continuous products using aprotic electrolytes free of water and oxygen is not known from prior art. Up to now, continuous products such as wires, tapes, long-profiles, and pipes are provided with a corrosion-inhibiting coating either by using electrolytic zinc plating in aqueous systems or hot-dip aluminizing or hot-dip galvanizing.

It is the technical object of the invention to provide a process which avoids the above-mentioned drawbacks of previously known coating processes for continuous products, is favorable in cost, and results in a superior coating. In addition, performing said process should be possible with no changes occurring in the basic material and particularly, at low temperatures.

The technical object is achieved by a process for electroplating metallic or non-metallic continuous products with metals or alloys in a continuous process from aprotic electrolytes free of water and oxygen, wherein the continuous product is passed through a lock system into an encapsulated coating plant under inert gas atmosphere, and the following steps are performed at temperatures of $\leqq 120°$ C.:

activating the continuous product to be coated;

rinsing the continuous product to be coated;

contacting the continuous product to be coated;

electroplating the continuous product to be coated using a metal or metal alloy;

drying the coated continuous product;

discharge of the coated continuous product from the plant through a lock system.

In the meaning of the invention, continuous products are understood to be metallic or non-metallic materials which are produced in rolled or folded form and passed continuously through the plant in a continuous process during coating. Amongst these products are, e.g., wires of any thickness, tapes and long-profiles, pipes and similar products.

In the meaning of the invention, non-aqueous systems are designated as electrolytes, which permit controlled pure deposition of the metal or metal alloy, particularly aluminum and aluminum alloys by means of the electrolytic process, with no intermediate or support layer.

In a preferred embodiment, wire, tapes, long-profiles or pipes made of metallic or non-metallic materials are employed as continuous products. It is preferred that these materials be coated with aluminum or aluminum alloys.

A BRIEF DESCRIPTION OF THE DRAWINGS

FIG. 3 shows a coating cell, wherein FIG. 3*a* shows a front view, FIG. 3*b* shows a side view and FIG. 3*d* shows a top view. FIG. 3*c* shows a perspective view of the entire coating cell.

FIG. 4 shows the contacting cell, wherein FIG. 4*a* shows an enlarged side view of the contacting cell and FIG. 4*b* shows a perspective view of the entire contacting cell.

FIG. 5 shows a diagram of the overall process using a coating cell, the contacting cell and the rinsing units, wherein FIG. 5*a* shows a top view and FIG. 5*b* shows a side view.

Figure 1:
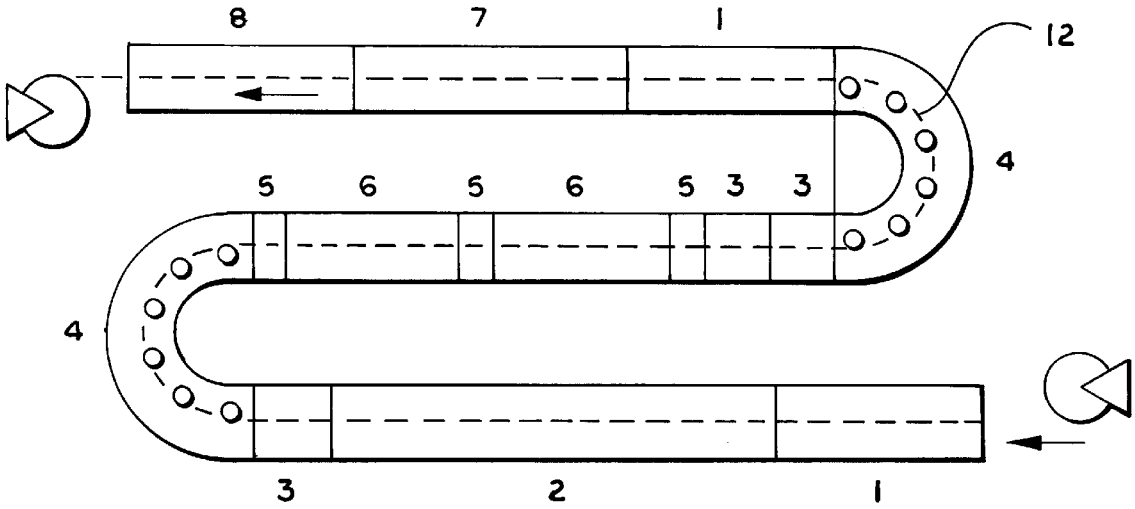
FIG. 1 shows a processing diagram of the process according to the invention.

FIG. 1 shows the individual processing steps of the process according to the invention. The continuous product is unwound from a reel and introduced into the coating plant through a lock. Even during introduction into the lock system, a cleaning procedure can be performed by passing the continuous product over a gas stripping nozzle or spray nozzle (cf., FIG. 2, number 11). Then, as a second processing step, the material to be coated is activated. Number 3 denotes a rinsing unit wherein the material is rinsed after activation. Number 4 describes a deflector unit having one or more pulleys which is used to reduce the overall size of the plant and is particularly reasonable in the case of continuous products having small diameters. The succeeding numbers 5 describe individual contacting cells, the numbers 6 describe the coating cells, and the numbers 7 denote the subsequent treatment. At the end of the process, the coated product is wound onto an appropriate reel.

In a preferred embodiment, the electroplating in the plant may be followed by a chemical or electrochemical aftertreatment which may also be associated with simultaneous or subsequent color styling within the surface structure. The aftertreatment involves a mechanical surface compacting resulting in a highly glossing surface, the surface not being affected by said aftertreatment.

In another preferred embodiment, the entire plant is of a closed design by using regeneration cycles, and all the liquids used are processed, purified and re-circulated in a circulation process. In particular, this is done for the rinsing solutions, the electrolyte solutions and the activating solution, which may be filtrated and/or distilled as required.

Figure 2:
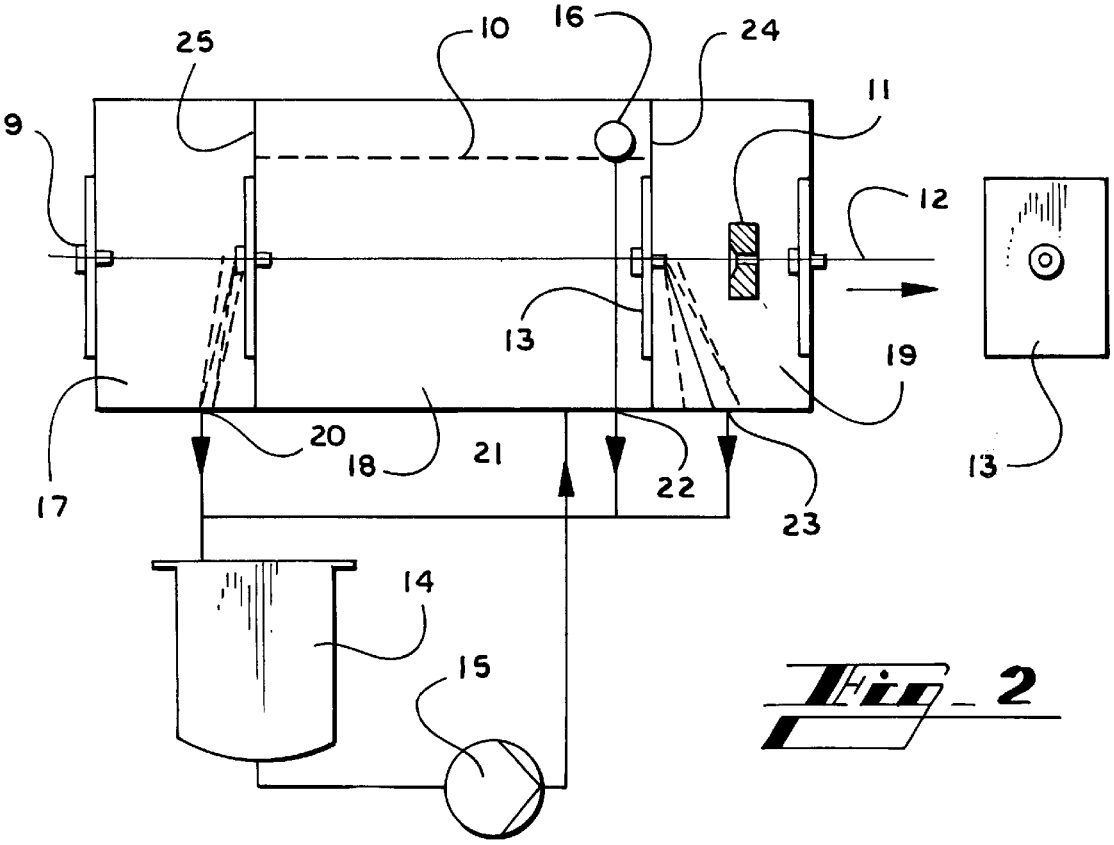
FIG. 2 shows an illustration of the lock system.

In another preferred embodiment, the continuous product is passed through the lock system and the rinsing system, each consisting of at least three chambers; the middle chamber B is filled with a sealing fluid, the outer chamber A contains air and the inner chamber C an inert gas (cf., FIG. 2). In another preferred embodiment, the continuous products are passed into the chambers through guides which are not hermetically tight, so that part of the liquid in each chamber runs into the adjacent chambers.

Referring to the lock chamber, for example, these measures prevent moisture or oxygen from entering the plant when introducing the continuous product. The sealing fluid in the middle chamber B represents a barrier for the air contained in the outer chamber A. Due to the design of the guides between the chambers in non-liquid-tight form, part of the sealing fluid runs from the middle chamber B into the chambers A and C. In this way, the introduced continuous product is rinsed at these sites. Liquid collected in chambers A and C is passed into a storage tank through a drain system and is recirculated into the middle chamber B through an appropriate pump and a filtering means.

Figure 5:
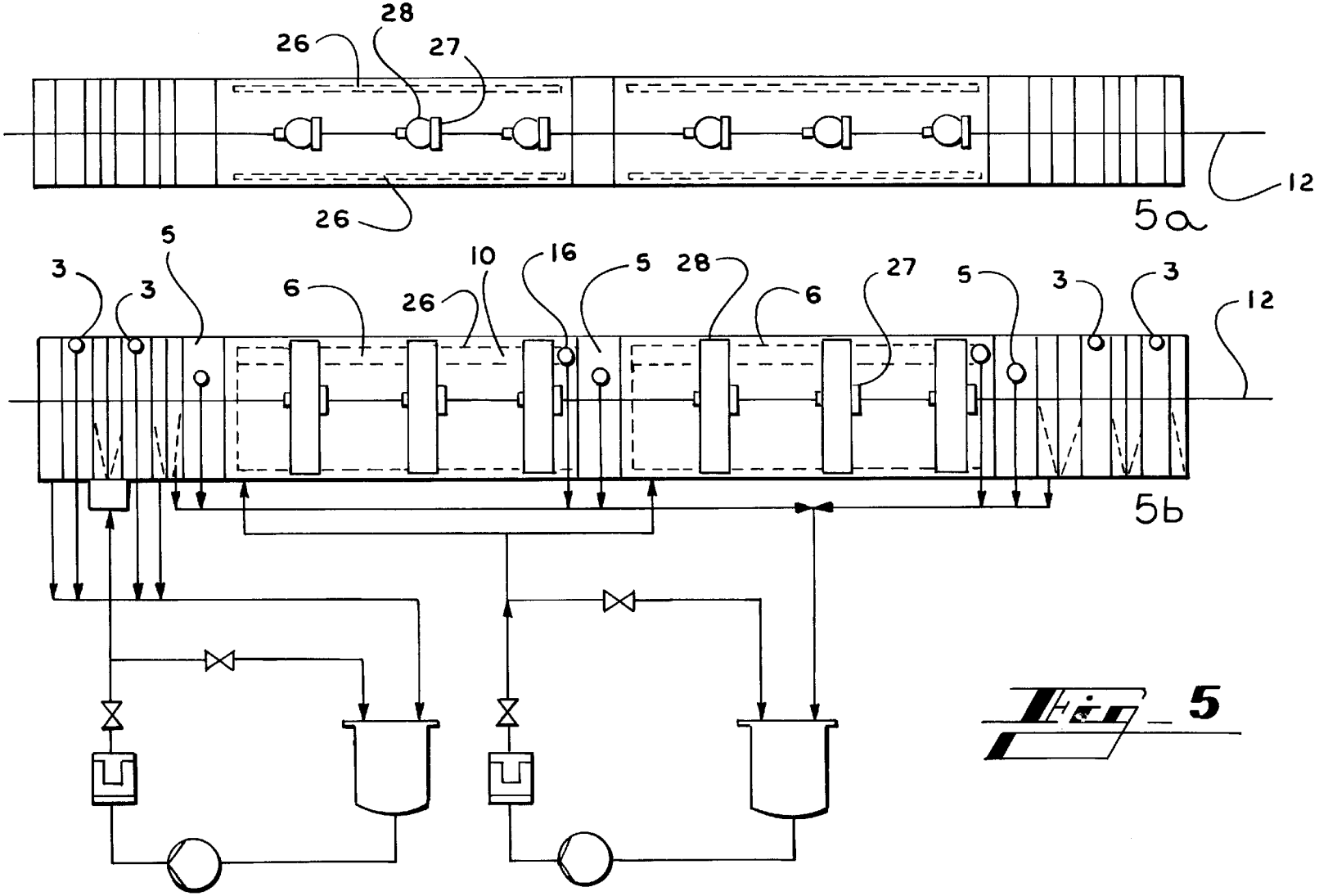

The rinsing chambers depicted in FIG. 5 are constructed in a similar fashion, so that here as well, no liquid or gas from the previous baths can reach the succeeding chambers.

In another preferred embodiment, liquid discharging from the chambers through the overflow or the guides is purified through a circulation system and recirculated into the respective chamber. Bushings or pulleys are preferably used as guides between the chambers. Contacting is preferably effected in a chamber filled with liquid electrolyte, which does not include an anode, the continuous product being passed over a metal contact in cathodic connection. The liquid level in the contacting cell is preferably lower than that of the adjacent coating cell, so that electrolyte solution may run out of the coating chamber through the guides and into the contacting chamber, thus preventing the possibility of reducing the purity of the electrolyte solution by impurities entrained from the contacting chamber.

In another preferred embodiment, electroplating is performed in a coating chamber filled with electrolyte solution, where the continuous product is passed through a bushing which is insulated.

By these measures in the coating cell one achieves that the voltage for the continuous product is supplied in chambers where no anode is present, so that there is no growth of deposited metal in these contacting cells, e.g., on the cathode guides under voltage. No current lead is present in the coating chambers themselves, so that the metal is deposited on the continuous product only. Depending on length and size of the plant, the contacting and coating cells may be arranged in any number.

Introducing the wire into the device of the invention is effected via vacuum or liquid lock systems of particularly convenient design, the latter being of similar design as the contacting cells between the coating cells. This can be done for both single and multi-wire systems. At the same time, the sealing medium may serve to clean the wire surface. Between the lock systems, the processes invariably take place under a completely inert atmosphere. In the rinsing units, contacting cells and coating cells, the wire guides are intentionally designed in such a way that the wire is passed through the coating cell at a constant spacing to the anodes serving as coating material without having electrical contact to neighboring wires or the anode.

Between the coating cells, there is an overflow system where electric contact of the wire is effected in contacting cells in order to provide constant stable conditions over the entire length of the plant.

The special feature of the invention is that the wire in this area as well must be inside the electrolyte liquid whereas contacting is effected outside the direct coating areas. In addition to the inert atmosphere, sealing from the environment is effected by overflow systems similar to the lock systems mentioned above. According to the invention, contacting is effected in a slipping or rolling manner through spring-mounted contact elements where flexible diameter adaptation is possible. As a result of such contacting devised according to the invention and occurring outside the coating area, there is no growth on contact pulleys or contact elements.

According to the invention, the wire—particularly in case of a thin wire—may be passed several times through the coating units via specially designed deflector systems, so that a highly efficient plant confined to a small length is possible. In a particularly convenient design of plant technology and process, it is intended in those cases where the plant is stopped, to leave the continuous product in its original position by using storage containers, so that in contrast to traditional processes, start-up losses are avoided.

The invention ensures that mechanical or physical-chemical stripping processes do not affect the uniformity or homogeneity of the applied surface coating. In the process of the invention it is possible to easily replace the aluminum electrodes in the coating cells and immediately resume operation.

According to the invention, the auxiliary units, such as filters and storage systems for lock fluid, cleaning media and electrolytes are designed in such a fashion as to permit a closed operation independent of the environment. Waste products are discharged in concentrated form capable of recycling. Using the components described according to the invention, the illustrated process provides the opportunity of a chemical passivation of the coating, representing a substantial increase of corrosion resistance. Color tinting of the coating itself, not in the form of a paint, which is possible according to the invention, substantially increases the mechanical durability of such a coloration compared to lacquers. Due to the variety of coating materials and electrolytes that are possible in the process according to the invention, the corrosion resistance in both the acidic and alkaline ranges is substantially increased compared to the illustrated traditional processes. The inventive design of the areas where the wire discharges from the coating and rinsing sections permits obtaining the wire in a dry or even surface-thickened form in colors as desired and with appropriate coating layers.

The invention is also directed to a device for electroplating metallic or non-metallic continuous products with metals or metal alloys in a continuous process from aprotic electrolytes free of water and oxygen, which consists of at least one lock system 1, at least one contacting cell 5, at least one coating cell 6, these assemblies being arranged in series in any number, and the entire device being encapsulated so as to be air-tight. Such a device may also be used, e.g., for performing the process of the invention.

FIG. 2 shows a diagram of the lock system 1 which preferably consists of at least three chambers A, B and C, 17, 18, 19, the middle chamber B having a liquid overflow 16, and the chambers A and C being designed as overflow chambers. More preferably, the chambers A, B and C have outlets 20, 22 and 23, the middle chamber additionally having an inlet 21 through which the sealing fluid collected in chambers A and C can be recirculated into the middle chamber B. Number 14 denotes a storage tank, number 15 an appropriate Dump. Number 9 denotes the wire guide, number 17 denotes chamber A, number 18 chamber B, and number 19 chamber C. Number 12 denotes the continuous product which is passed through the chamber, and number 1 is a gas stripping nozzle or spray nozzle used for additional cleaning of the surface of the continuous product 12 passed through the plant, which use is preferred. The numbers 24 and 25 denote inner chamber walls, and number 13 denotes an exchangeable plate for bushings, making it possible to employ continuous products of varying diameter, where the appropriate bushing must be inserted each time. Number 10 denotes the liquid level.

FIG. 3 shows a coating cell. The FIGS. 3*a*, 3*b* and 3*d* show different views of the support 28 for the continuous product 12, which support is situated in the cell. FIG. 3*a* shows a front view, FIG. 3*b* a side view, and FIG. 3*d* a top view. FIG. 3*c* is a perspective view of the entire coating cell 6. In FIGS. 3*a*, 3*b* and 3*d*, number 28 denotes the support made of an insulating material. Number 27 shows the ceramic bushing which is split in two parts. The bushing is arranged in such a way to allow removal out of the insulating material in opposite direction to the passage of the introduced continuous product and may be replaced by bushings having other diameters, for example.

FIG. 3*c* shows the entire coating cell 6 with the anode plates 26 and the support 28 arranged in the center, and the bushing 27.

The coating cell 6 preferably has guides for guiding the continuous product 12, which are designed in such a way as to ensure a constant spacing between the anodes 26 arranged in the coating cell and the continuous product 12 to be coated. In another preferred embodiment, the coating cell has an overflow and an inlet for the electrolyte.

The guides in the coating cells consist of a support 28 made of an insulating material having a boring in the center, with bushings 27 being arranged in the boring, which are penetrable from one side only and preferably consist of a ceramic material and are split in order to make replacement easier when continuous products of varying diameter are used.

FIG. 4 shows a diagram of the contacting cell 5. FIG. 4*a* represents an enlarged view of the contacting area as a side view. FIG. 4*b* shows a perspective view of the contacting cell 5. In FIG. 4*b*, number 12 denotes the continuous product which is passed between a metal pulley 29 under cathodic voltage and a non-conducting ceramic tension pulley 30, with number 32 denoting the grooves in the metal pulleys for improved guidance of continuous product 12. Number 33 denotes the holder elements for the metal pulleys and the ceramic tension pulleys. FIG. 4*a* shows an enlarged section of the contacting area. Number 29 denotes the metal pulley, number 31 a bronze socket for power supply, number 12 the continuous product, and number 30 denotes the ceramic tension pulleys which are used to adjust the initial tension for the continuous product by means of springs and set-screws.

The contacting cell 5 is preferably designed in such a way as to have a metal pulley or a wiping contact arranged therein, through which the continuous product is connected as cathode. In addition, one or more ceramic tension pulleys can be arranged to adjust the initial tension in the contacting cell. In a preferred embodiment, the metal pulley has a groove for guiding the continuous product. Preferably, an overflow is also arranged in the contacting cell, so that electrolytes discharging from the electrolytic cell can be drained off into a collector system.

FIG. 5 shows a view of the coating cell 6, the contacting cell 5 and the rinsing units 3. FIG. 5*a* shows the top view of these cells, and FIG. 5*b* a side view. It can be seen that the rinsing units 3 are designed in a similar fashion as the lock systems in FIG. 2 described above. Similarly, they have an overflow and adjacent overflow chambers, with each of the middle chambers being filled with liquid. The liquid may run into the adjacent chambers through the non-tight guides and is collected through appropriate outlets and recirculated into the rinsing chambers. Number 5 denotes the contacting cells which are preferably arranged adjacent to the coating cells 6 and filled with electrolyte. Number 6 shows the coating cells with anodes 26 and supports 28 made of insulating material and the ceramic bushings 29 arranged therein for guiding the continuous products 12 in the coating cells. The coating cells are also filled with electrolyte and have an overflow, an outlet and an inlet through which the respective electrolyte liquids can be circulated, purified and recirculated.

The device of the invention has substantial advantages compared to previously known devices for metallizing continuous products. Thus, the wire can be stably positioned through non-conducting pipes and pulley guides within the device and particularly in the electric field of coating cell 6. As a result of this stable guidance it is possible to pass multiple parallel strands of continuous products, e.g., multiple wires, even in vertical arrangement, through the device, with no undesirable electric contacts occurring, and a constant spacing to the anode being ensured. By means of the lock systems 1, rinsing units 3 and contacting cells 5 constructed as overflow chambers, an intermediate electric contact outside the range of influence of the anode material is possible, with the continuous product steadily remaining in the electrolyte. The electric energy in the contacting cells 5 may be transferred both through wiping contacts in the form of flexible, spring-mounted contact pins and through springy contact pulleys.

Due to the special bearing of the continuous product in the contacting cell 5 and the guides in the coating cell 6 it is possible to run continuous products having varying diameters. Owing to the preferred deflector units 4 it is possible to pass the continuous products through multiple parallel coating cells, thus permitting high passage rates in relatively short plants.

Even when stopping the plant, the continuous product may remain in the chambers without the possibility of an excessive reaction at the surface, such as excessive pickling or excessive coating on one side, because the reaction media are stored in intermediate containers outside the reaction area, the inert atmosphere in the plant being maintained. Furthermore, it is advantageous that the anode material can be replaced when the plant is idle without removal of the material to be coated.

Using the process and device according to the invention, it is possible for the first time to coat continuous products with metals, particularly aluminum, in a process conducted on an industrial scale using an appropriate device. Thus, the process and device according to the invention replace the methods of hot-dip aluminizing, hot-dip galvanizing and electroplating in aqueous media which have been used exclusively up to now.

REFERENCE NUMBERS

1 Lock system
2 Activation
3 Rinsing unit
4 Deflector unit having one or more pulleys
5 Contacting cells (in any number)
6 Coating cells (in any number)
7 Aftertreatment
8 Drying/discharge
9 Guide
10 Liquid level
11 Gas stripping nozzle or spray nozzle
12 Continuous product
13 Exchangeable plate for guide
14 Storage tank for liquid
15 Pump
16 Overflow
17 Outer chamber A
18 Middle chamber B
19 Inner chamber C
20 Outlet from outer chamber A
21 Inlet to middle chamber B
22 Outlet from middle chamber B
23 Outlet from inner chamber C
24, 25 Walls of inner chamber
26 Anode plates
27 Ceramic bushings
28 Support made of insulating material
29 Metal pulley contacts
30 Ceramic tension pulleys
31 Bronze sockets
32 Groove in metal pulleys
33 Holder elements

What is claimed is:

1. A process for electroplating one or more metallic or non-metallic continuous products with metals or metal alloys in a continuous process from aprotic electrolytes free of water and oxygen, wherein a continuous product is passed through a lock system (1) into an encapsulated coating plant, and the following steps are performed within the encapsulated coating plant under inert gas atmosphere at temperatures of $\leqq 120°$ C. in the following order:

a. activating the continuous product;
b. rinsing the continuous product;
c. contacting the continuous product electrically;
d. electroplating the continuous product using a metal or metal alloy to form a coated continuous product;
e. drying the coated continuous product; and
f. discharging the coated continuous product from the coating plant through a lock system;

wherein the continuous product is passed from outside through the lock system (1) into the encapsulated coating plant and the activation and rinsing of the continuous product are performed thereafter in the coating plant.

2. The process according to claim 1, wherein the continuous product comprises wire, tapes, long-profiles or pipes made of metallic or non-metallic materials.

3. The process according to claim 1 wherein the metal or metal alloy is aluminum or aluminum alloys.

4. The process according to claim 1, further comprising cleaning the continuous product in the lock system (1), by passing the continuous product (12) over a gas stripping nozzle or spray nozzle (11).

5. The process according to claim 1, characterized in that the electroplating in the plant is followed by a chemical or electrochemical aftertreatment.

6. The process according to claim 1, characterized in that the entire plant is of a closed design by using regeneration cycles, and all liquids used are processed, purified and recirculated in a circulation process.

7. The process according to claim 6 characterized in that the liquids are rinsing solutions, electrolyte solution and activation solution.

8. The process according to claim 1 characterized in that the continuous product (12) is passed through deflector units (4) in order to permit high passage rates in short plants.

9. The process according to claim 1 characterized in that the continuous product (12) is passed through the lock system (1) and a rinsing unit (3), each consisting of at least three adjacent chambers (17, 18 and 19), wherein a middle chamber B (18) is filled with a liquid, a first chamber A (17) contains air, and a last chamber C (19) contains an inert gas.

10. The process according to claim 9 characterized in that the continuous product is introduced into the adjacent chambers through non-airtight and non-liquid-tight guides (9), so that part of the liquid in the chambers may run into the adjacent chambers.

11. The process according to claim 10 characterized in that the non-airtight and non-liquid-tight guides (9) are bushing or pulleys.

12. The process according to claim 10 characterized in that the liquid discharging from the adjacent chambers through an overflow (16) or the non-airtight and non-liquid-tight guides (9) are purified through a circulation system and recirculated into the chambers.

13. The process according to claim 9, wherein the liquid in the middle chamber B (18) of the lock system is filled with a sealing fluid liquid.

14. The process according to claim 9, wherein the liquid in the middle chamber B (18) of a rinsing unit is filled with a rinsing fluid liquid.

15. The process according to claim 1, wherein contacting further comprises, within a contacting cell (5), passing the one or more continuous products (12) over a metal contact (29) connected as a cathode, wherein the contacting cell is filled with liquid electrolyte and does not include an anode.

16. The process according to claim 1, wherein electroplating further comprises, within a coating chamber (6), passing the one or more continuous products (12) through an insulated bushing (27), wherein the coating chamber is filled with electrolyte solution.

* * * * *